US010543466B2

(12) United States Patent
Wu

(10) Patent No.: US 10,543,466 B2
(45) Date of Patent: Jan. 28, 2020

(54) HIGH RESOLUTION TEMPERATURE PROFILE CREATION IN A DIGITAL MICROFLUIDIC DEVICE

(71) Applicant: Digital BioSystems, Menlo Park, CA (US)

(72) Inventor: Chuanyong Wu, Menlo Park, CA (US)

(73) Assignee: Digital BioSystems, Menlo Park, CA (US)

( * ) Notice: Subject to any disclaimer, the term of this patent is extended or adjusted under 35 U.S.C. 154(b) by 106 days.

(21) Appl. No.: 15/638,032

(22) Filed: Jun. 29, 2017

(65) Prior Publication Data

US 2018/0001286 A1 Jan. 4, 2018

Related U.S. Application Data

(60) Provisional application No. 62/356,418, filed on Jun. 29, 2016.

(51) Int. Cl.

| | |
|---|---|
| ***F15C 1/04*** | (2006.01) |
| ***B01F 13/00*** | (2006.01) |
| ***B01L 7/00*** | (2006.01) |
| ***B01F 15/06*** | (2006.01) |
| ***B01L 3/00*** | (2006.01) |

(52) U.S. Cl.

CPC ..... *B01F 13/0084* (2013.01); *B01F 13/0006* (2013.01); *B01F 15/06* (2013.01); *B01L 3/50273* (2013.01); *B01L 7/525* (2013.01); *B01L 2200/0605* (2013.01); *B01L 2300/1827* (2013.01); *B01L 2400/0427* (2013.01)

(58) Field of Classification Search

CPC ..... B01F 13/0084; B01F 13/0006; B01F 13/0071; B01F 15/065; B01F 15/06; B01F 2015/062; B01L 3/50273; B01L 3/502792; B01L 7/525; B01L 2200/0605; B01L 2200/147; B01L 2200/0673; B01L 2300/1827; B01L 2400/0427

USPC ..... 137/829, 831, 833

See application file for complete search history.

(56) References Cited

U.S. PATENT DOCUMENTS 5,001,594 A * 3/1991 Bobbio ..... H01L 21/6831 361/230

6,113,768 A * 9/2000 Fuhr ..... B01F 13/0076 204/450

(Continued)

OTHER PUBLICATIONS

International Search Report and Written Opinion dated Nov. 9, 2017 for International Application No. PCT/US2017/040068 filed on Jun. 29, 2017.

*Primary Examiner* — Minh Q Le

(74) *Attorney, Agent, or Firm* — K&L Gates LLP; Louis C. Cullman; Brian J. Novak

(57) ABSTRACT

Designs of a digital microfluidic devices are described comprising droplet control electrodes and heating electrodes that have effects in the regions for droplet manipulations. Specifically, the digital microfluidic device comprises a first substrate having liquid control electrodes for droplet control and a second substrate having heating electrodes for temperature control. Shielding electrodes are disposed on the second substrate to ensure that the heating electrodes can control the digital microfluidic device to a desired temperature profile without interfering the droplet operations such as transport, merging/mixing, splitting, particle distribution, etc.

19 Claims, 5 Drawing Sheets

(56) References Cited

U.S. PATENT DOCUMENTS 6,294,063 B1 * 9/2001 Becker ..... B01F 13/0076 204/450
6,565,727 B1 * 5/2003 Shenderov ..... B01F 13/0071 204/600
7,014,747 B2 * 3/2006 Cummings ..... B03C 5/026 204/450
8,147,668 B2 * 4/2012 Pollack ..... B01F 13/0071 204/547
8,409,417 B2 4/2013 Wu
8,685,344 B2 * 4/2014 Sudarsan ..... B01F 13/0071 204/600
8,926,811 B2 1/2015 Wu
2003/0164295 A1 * 9/2003 Sterling ..... B01L 3/50273 204/450
2003/0183525 A1 * 10/2003 Elrod ..... B01F 5/0085 506/32
2004/0096958 A1 * 5/2004 Pottathil ..... B01L 3/5023 435/287.2
2004/0211659 A1 * 10/2004 Velev ..... B01F 13/0071 204/164
2004/0231987 A1 * 11/2004 Sterling ..... B01L 3/50273 204/450
2006/0021875 A1 * 2/2006 Griffith ..... B01F 13/0071 204/451
2008/0274513 A1 * 11/2008 Shenderov ..... B01L 3/502792 435/91.2
2009/0155902 A1 * 6/2009 Pollack ..... G01N 35/10 435/372.2
2010/0163414 A1 * 7/2010 Gillies ..... B01L 3/502715 204/547
2011/0042220 A1 * 2/2011 Wang ..... B01L 3/502792 204/643
2011/0056834 A1 * 3/2011 Fan ..... B03C 5/026 204/643
2012/0268804 A1 10/2012 Hadwen
2014/0302562 A1 * 10/2014 Burroughs ..... B01L 7/52 435/91.2
2015/0001084 A1 * 1/2015 Peter ..... G01N 27/44791 204/601
2015/0021182 A1 * 1/2015 Rival ..... B01L 3/50273 204/450
2015/0336098 A1 11/2015 Pollack et al.
2016/0245790 A1 * 8/2016 Kawai ..... C12Q 1/6813

* cited by examiner

HIGH RESOLUTION TEMPERATURE PROFILE CREATION IN A DIGITAL MICROFLUIDIC DEVICE

CROSS REFERENCE TO RELATED APPLICATIONS

This application claims the benefit of U.S. provisional patent application No. 62/356,418, filed Jun. 29, 2016, the entire disclosure of which is incorporated herein by reference.

FIELD

The invention relates generally to microfluidic devices, for example, in the field of molecular biology.

BACKGROUND

Droplet microfluidics is a relative new but rapidly advancing field. It provides methods to manipulate liquid droplets and/or the particles in the droplets by employing mechanisms such as electrowetting [WO2008147568, Electrowetting Based Digital Microfluidics], electrophoresis [WO2014036914, Method and Device for Controlling, Based on Electrophoresis, Charged Particles in Liquid], and dielectrophoresis [WO2014036915, Dielectrophoresis Based Apparatuses and Methods for the Manipulation of Particles in Liquids], etc. It provides droplet operation capabilities such as droplet dispensing and transport, merging and mixing of multiple droplets, splitting one droplet to two (or more) daughter droplets, incubation, waste disposal, particles (such as DNA/RNA/protein molecules, cells, beads, etc.) redistribution/enrichment/separation, etc. Droplet microfluidics provides the capability to handle all the basic steps of liquid analysis, including sampling, sample preparation, reaction, detection, and waste handling, etc. It can practically handle droplets with volume ranging from a few pico-liters to tens of microliters—a span of more than 6 orders of magnitude. It finds applications in medical diagnostics, cancer screening, drug discovery, food safety inspection, environmental monitoring, forensic analyses, and many others. Besides miniaturization and integration, it offers other advantages such as low cost, automation, parallelism, high throughput, low energy consumption, etc.

A typical digital microfluidic (DMF) device consists of two solid substrates separated by a spacer to form a gap in-between. Liquids are operated in the gap in a discrete fashion, i.e., in the format of droplets. Different from channel based microfluidics, in digital microfluidics, the liquid/droplet path can be changed during run-time by the control software, and the droplets can be operated individually. Digital microfluidics truly fulfill the promise of the lab-on-a-chip concept, which is to handle all the basic steps of an analysis, including sampling, sample preparation, reaction, detection, and waste handling, etc. Digital microfluidics shares great similarities with bench based liquid handling. Established bench based protocols can be easily adapted to the digital microfluidics format.

Chemical and biochemical reactions often need a well-regulated temperature profile to perform efficiently. For example, in DNA amplification methods like Polymerase Chain Reaction (PCR), Ligase Chain Reaction (LCR), transcription-based amplification, and restriction amplifications, etc., the reactions require cycling between higher denaturing temperatures and lower polymerization temperatures. Other nucleic acid amplification methods require the reaction to take place at a specified constant temperature, such as Self-Sustained Sequence replication (3SR), Rolling-Circuit Amplification (RCA), Strand Displacement Amplification (SDA), and Loop Mediated Amplification (LAMP), Helicase-Dependent Amplification (HAD), etc. The detection of the fluorescence intensity changes when a DNA molecule going through a well-defined temperature profile can provide great insight such as the presence and identity of single nucleotide polymorphisms (SNP)—a process called melting curve analysis.

Well-regulated temperature control is also important in the processing of RNA and protein molecules, for example, real time RT-PCR (Reverse Transcription-Polymerase Chain Reaction and Isothermal RNA Signal Generation (IRSG) for RNA detection and real time immuno-PCR and IAR (Isothermal Antibody Recognition) for protein detections. Cell lysis is generally temperature dependent too.

Due to its great sensitivity, PCR is one of the most commonly used nucleic acid amplification and quantification methods in clinical diagnostics, forensic science, and environmental science, etc. While the reaction at molecular level is typical very fast, the speed of PCR is often limited by the time it takes to cycle through different needed temperatures. Fast/ultrafast PCRs are often highly desirable, especially in the situation of infectious disease diagnostics, bio-warfare and pathogen identification, forensic analyses, etc. It is even more desirable to achieve fast/ultrafast PCRs with low power consumption, compact size and simple operation.

Microfluidic thermal management has long been a major issue. Many techniques have been explored to regulated the temperature within microfluidic systems. They range from the use of Peltier [Maltezos, G. et al, Microfluidic polymerase chain reaction, Appl. Phys. Lett. 2008, 93, 243901: 1-243901:3], Joule heating [Mavraki, E. et al, A continuous flow μPCR device with integrated micro-heaters on a flexible polyimide substrate. Procedia Eng. 2011, 25, 1245-1248], endothermal chemical reactions [Guijt, R. M. et al, Chemical and physical processes for integrated temperature control in microfluidic devices. *Lab Chip* 2003, 3, 1-4], microwaves [Shaw, K. J. et al, Rapid PCR amplification using a microfluidic device with integrated microwave heating and air impingement cooling. Lab Chip 2010, 10, 1725-1728], and Lasers [Kim, H. et al, Laser-heated reactions in nanoliter droplet arrays. *Lab Chip* 2009, 9, 1230-1235], etc. Now, people are still looking for reliable, easy-to-use, and economical ways to regulate temperature in a microfluidic system.

Patent WO2009003184 [Digital Microfluidics Based Apparatus for Heat-Exchanging Chemical Processes] presented a device design and method to use external temperature control modules to create different temperature zones on the device. Heat-exchanging chemical processes such as PCR can be performed by transporting the reaction droplets back and forth between different temperature zones.

However, the above mentioned use of external temperature control modules on a microfluidic device has its limitations. When contact temperature control modules are used, the bottom and cover substrates of the microfluidic device act as diffusers, which limits the temperature resolution at the device gap where reactions take place. When using non-contact heating methods such as photonic-based heating [Ultrafast photonic PCR, J H Son, et al., Light: Science & Applications (2015) 4] or microwave heating [K J Shaw, et al., Rapid PCR amplification using a microfluidic device with integrated microwave heating and air impingement cooling. Lab Chip 10:1725], complex and expensive focusing mechanisms would be needed to achieve high spatial temperature resolution.

In one embodiment, provided are simple and cost effective approaches to implement high spatial resolution temperature control in a droplet microfluidic device. By disposing the heating electrodes on the cover plate surface facing the device gap in which droplets are manipulated, many different temperature zones can be created in the device gap to provide ideal reaction environments for different chemical/biochemical reactions. A shielding electrode, which is typically grounded electrically, is disposed to cover (at least partially) the heating electrodes. This shielding electrode prevents the droplets from being affected by the possible electric and/or magnetic field(s) generated by the heating electrodes. External temperature control modules, such as Peltiers or water/air cooling blocks, can be used together with the heating electrodes increase the temperature control range, for example, to below the room temperature.

The temperature of a controlled region in the gap of a droplet microfluidic device can range from −20° C. (minus 4° C.) to 200° C., and preferably from 0° C. to 120° C., and more preferably from 20° C. to 98° C.

In one aspect, the heating electrodes can be integrated with feedback control. For example, a typical implementation of a heating electrode is to deposit a layer of conductive material at specific thickness, width and length, so that it has a specific resistance. When an electric current is going through the heating electrode, the heat is generated—Joule heating. The heating electrode is can be called a resistive heater. In general, the resistance value of a resistive heater is temperature dependent. By measuring the resistance change, the temperature change (compared to a starting point) can be calculated. This means the resistive heater can also be used as temperature sensor. Other temperature sensors such as, but not limiting to, thermal couple, thermistor and separated resistance temperature detector (RTD) can be used to continuously monitor the temperature profile of the device. These sensors can be placed in the device gap, or on the top or bottom plate(s) of the device temporarily for temperature calibration or permanently to enable closed-loop temperature control during run-time.

Melting curve analysis is an assessment of the dissociation-characteristics of double-stranded DNA during heating. The information gathered can be used to infer the presence of and identity of single nucleotide polymorphisms. The present invention provides methods for implementing temperature sweeps needed for melting curve analyses. In one aspect, the invention provides methods to implement temperature changes through spatial variation. Thus, two or more regions of the device can be set to different temperatures (proper for melting curve analysis), at thermal equilibrium, a path (or multiple paths) of continuous temperature change from the temperature at the highest temperature region to the temperature at the lowest temperature region can be designed on the device. A droplet of PCR product can be moved along this path (or paths), and the fluorescence measured as the PCR product moves along the path. The change in fluorescence can be used to obtain the melting curve for the DNA strand. In another aspect of the invention, the droplet of PCR product can be made to remain stationary at one location and the temperature(s) at the location can be changed. The fluorescence data can be collected at said location to obtain the melting curve for the DNA strand.

DNA sequencing is the process of determining the precise order of the four chemical building blocks, called "bases," that make up the DNA molecule. Sequence data, among many things, can highlight changes in a gene that may cause disease. Although DNA sequencing technology and platforms being rapidly developed, the sample processing, also called library preparation, lacks behind. This is an area that droplet microfluidics can offer help.

Library preparation typically has a few major steps—genomic DNA fragmentation, end repair, adding 'A' bases to the 3' end of the DNA fragments, adapter ligation to DNA fragments, ligation products purification, PCR amplification of the adapter-modified DNA fragments, etc. Different steps often require different temperature profile. This invention provides a convenient approach to create the needed temperature profile on the droplet microfluidic device to enable fast library preparation.

SUMMARY

Described are apparatus and methods for independent temperature control in a droplet microfluidic device without affecting the droplet operations such as droplet dispensing and transport, merging and mixing of multiple droplets, splitting one droplet to two (or more) daughter droplets, incubation, waste disposal, particles (such as DNA/RNA/protein molecules, cells, beads, etc.) redistribution/enrichment/separation, etc.

The present apparatus and methods enable fast and sensitive DNA analyses at microfluidic level. Especially, it allows the integration of different analysis methods such as isothermal amplification and qPCR, PCR and melting curve. In some embodiments, the herein described devices can make it possible to create high resolution temperature profiles in the microfluidic devices. This makes DNA analyses fast, simple, possess high throughput, cost effective, and highly sensitive.

A PCR requires the repetition of heating and cooling cycles, in order to repeat the denaturation, annealing and extension processes, in the presence of an original DNA target molecule, specific DNA primers, deoxynucleotide triphophates, and thermal-stable DNA polymerase enzymes and cofactors. Each temperature cycle doubles the amount of target DNA sequence, leading to an exponential accumulation of the target sequence. In a typical current commercial PCR instrument, the reaction mixture resides in a container such as a PCR tube or a microtiter plate. The PCR reaction mixture, its container, and the temperature control block are cycled through different temperature set points. The combined mass of the sample, the container, and the temperature control block, limits the speed of the PCR reactions. Some of the fast PCR reagents can finish one PCR cycle in a few seconds, while most of the commercial PCR systems take minutes.

Patent WO2009003184 presents a method to control different regions of a DMF device to different temperature set points. By transporting a droplet back and forth among the different temperature regions, a temperature dependent reaction can be sped up as only the small droplet needs to be temperature cycled. However, the method in Patent WO2009003184 is often limited by the number of PCR reactions that it can run simultaneously due to the limited number of temperature zones that can be created at any given time. The reason is that the heat-transfer in the materials used to make microfluidic devices such as glass, silicon, quartz, and plastic, is generally not directional. The heat spreads transversely as it travels from one side of a substrate to the other. The spatial resolution of the temperature profile created in the middle (or gap) of the DMF device cannot keep up with the spatial resolution of the temperature profile on the outer surfaces. For example, with the method presented in Patent WO2009003184, it is very challenging to create alternating 95° C. and 60° C. temperature zones 1 mm apart from each other in the middle of the device when using 1 mm thick glass or plastic substrates.

Digital PCR is a new approach to nucleic acid detection and quantification. It is a method of absolute quantification and rare allele detection relative to conventional qPCR, as it directly counts the number of target molecules rather than relying on reference standards or endogenous controls. A DMF device can be designed to work with droplets of 1 nL (nanoliter) or smaller, and thousands of droplets can be generated/dispensed and placed in the device. So, digital PCR can be performed on such devices, with a quick sample-to-result turnaround time too.

DETAILED DESCRIPTION

Figure 1A:
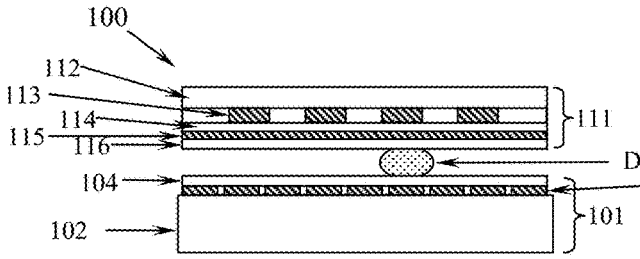
FIGS. 1A-1C present a cross-sectional view, of a single-layer-electrode-control of a droplet microfluidic device with heating electrodes on the cover plate, along with the top views of the droplet control electrodes and the heating electrodes.

The following are the definitions and/or explanations of some of the terminologies used in this patent application.

For purposes of the present disclosure, the term "microfluidic" refers to a device or a system having the capability of manipulating liquid with at least one cross-sectional dimension in the range of from a few micrometers to about a few hundred micrometers.

For purposes of the present disclosure, the term "droplet" is used to indicate one type (or a few types mixed together) of liquid of limited volume that is separated from other parts of liquid of the same type by air (or other gases), other liquids (typically not immiscible ones), or solid surfaces (such as inner surfaces of a DMF device), etc. The volume of a droplet can have a large range—from a few picoliters (pL) to hundreds of microliters (uL). A droplet can take any arbitrary shape, such as sphere, semi-dome, flattened round, or irregular, etc. The volume of the droplets may range from 1 pL to 100 uL, preferably from 10 pL to 10 uL, and more preferably from 50 pL to 5 uL.

The term "particles" is used to indicate micrometric or nanometric entities, either natural ones or artificial ones, such as cells, subcelluars components, viruses, liposomes, nanospheres, and microspheres, or even smaller entities, such as macro-molecules, proteins, DNAs, RNAs, etc., as well as droplets of liquid immiscible with the suspension medium, or bubbles of gas in liquid. The sizes of the "particles" range from a few nanometers to hundreds of micrometers.

The term "electrowetting" is used to indicate the effect that the change of the contact angle between a liquid and a solid surface due to an applied electric field. It should be pointed out that, when AC voltages or electric fields are applied, both the electrowetting effect and the dielectrophoretic effect exist. As the frequency of the AC voltages or electric fields increases, the dielectrophoretic effect will be more pronounced compared to the electrowetting effect. It is not the intent to strictly differentiate the electrowetting effect and the dielectrophoretic effect.

The term "electrophoresis" is used to indicate the phenomenon in which a charged particle suspended in a liquid medium or gel experiences a force under the influence of a spatially uniform electric field. Electrophoresis is a technique used in laboratories in order to separate and analysis macromolecules (DNA, RNA, and proteins) and their fragments, based on their molecular size and electrical charge.

The term "dielectrophoresis (DEP)" is used to indicate the phenomenon in which a neutral particle experiences a force when it is subjected to a non-uniform electric field. When a particle suspended in a liquid medium is exposed to a non-uniform electric field, it experiences a force that can cause it move to a region of higher electric field (positive dielectrophoresis) or to a region of lower electric field (negative dielectrophoresis). Unlike electrophoresis, the dielectrophoretic force does not require the particle to have charge. Also the dielectrophoretic force is insensitive to the polarity of the electric field. The effect of dielectrophoresis can occur in both AC (time varying) and DC (non-time varying) electric fields. All particles exhibit dielectrophoretic activity in the presence of non-uniform electric fields. The strength of the dielectrophoretic force depends on the particle's size and shape, the medium and the particle's electrical properties, as well as the frequency of the electric field.

For purposes of the present disclosure, the phrases "droplet microfluidic device" and "digital microfluidic device" are used interchangeably to denote a microfluidic device in which liquid is handled in a discrete format, i.e., droplets. Droplets can be individually manipulated.

For purposes of the present disclosure, the phrases "microfluidic devices" and "microfluidic chips" are used interchangeably to denote an apparatus in which liquid is handled at microliters level or smaller.

Apparatuses and methods are provided by this invention to detect target analytes in a sample solution. As will be appreciated by those in the art, the sample solution may include, but is not limited to, bodily fluids (including, but not limited to, blood, serum, saliva, urine, etc.), purified samples (such as purified DNA, RNA, proteins, etc.), environmental samples (including, but not limited to, water, air, agricultural samples, etc.), and biological warfare agent samples, etc. While the bodily fluids can be from any biological entities, the present disclosure is more interested in the bodily fluids from mammals, especially that from human.

For purposes of the present disclosure, the term "amplification" refers to a process that can increase the quantity or concentration of a target analyte. Examples include, but are not limited to, Polymerase Chain Reaction (PCR) and its variations (such as quantitative competitive PCR, immune-PCR, reverse transcriptase PCR, etc.), Strand Displacement Amplification (SDA), Nucleic Acid Sequence Based amplification (NASBA), Loop-mediated isothermal amplification (LAMP), helicase-dependent amplification (HAD), etc.

For purposes of the present disclosure, the terms "layer" and "film" are used interchangeably to denote a structure of body that is typically, but not necessarily planar or substantially planar, and is typically deposited on, formed on, coated on, or is otherwise disposed on another structure.

For purposes of the present disclosure, the term "communicate" (e.g., a first component "communicates with" or "is in communication with" a second component) is used herein to indicate a structural, functional, mechanical, electrical, optical, or fluidic relationship, or any combination thereof, between two or more components or elements. As such, the fact that one component is said to communicate with a second component is not intended to exclude the possibility that additional components may be present between, and/or operatively associated or engaged with, the first and the second components.

For purposes of the present disclosure, it will be understood that when a given component such as a layer, region or substrate is referred to herein as being disposed or formed "on", "in" or "at" another component, that given component can be directly on the other component or, alternatively, intervening components (e.g., one or more buffer layers, interlayers, electrodes or contacts) can also be present. It will be further understood that the terms "disposed on" and "formed on" are used interchangeably to describe how a given component is positioned or situated in relation to another component. Hence, the terms "disposed on" and "formed on" are not intended to introduce any limitations relating particular methods of material transport, deposition, or fabrication.

For purposes of the present disclosure, it will be understood that when a liquid in any form (e.g., a droplet or a continuous body, whether moving or stationary) is described as being "on", "at", "or "over" an electrode, array, matrix or surface, such liquid could be either in direct contact with electrode/array/matrix/surface, or could be in contact with one or more layers or films that are interposed between the liquid and the electrode/array/matrix/surface.

As used herein, the term "reagent" describes any material useful for reacting with, diluting, solvating, suspending, emulsifying, encapsulating, interacting with, or adding to a sample material.

As used herein, the term "electronic selector" describes any electronic device capable to set or change the output signal to different voltage or current levels with or without intervening electronic devices. As a non-limiting example, a microprocessor along with some driver chips can be used to set different electrodes at different voltage potentials at different times.

As used herein, the term "ground" in the context of "ground electrode" or "ground voltage" indicates the voltage of corresponding electrode(s) is set to zero or substantially close to zero.

For purposes of the present disclosure, the term "biomarker" refers to something that can be used as an indicator of a particular disease state or some other physiological state of an organism, or the body's response to therapy. A biomarker can be, a protein measured in (but not limited to) blood (whose concentration reflects the presence or severity of a disease), a DNA sequence, a traceable substance that is introduced into an organism as a means to examine organ function or other aspects of health, etc.

For purposes of the present disclosure, the term "amplification" refers to a process that can increase the quantity or concentration of a target analyte. Examples include, but are not limited to, Polymerase Chain Reaction (PCR) and its variations (such as quantitative competitive PCR, immune-PCR, reverse transcriptase PCR, etc.), Strand Displacement Amplification (SDA), Nucleic Acid Sequence Based amplification (NASBA), Loop-mediated isothermal amplification (LAMP), helicase-dependent amplification (HAD), etc.

For purposes of the present disclosure, the term "electronic selector" describes any electronic device capable to set or change the output signal to different voltage or current levels with or without intervening electronic devices. As a non-limiting example, a microprocessor along with some driver chips can be used to set different electrodes at different voltage potentials at different times.

By "manipulation" what is meant, in particular, includes one of the following operations and/or combinations thereof:

1. Selection, which includes the isolation of a particular type of particles from a sample containing a multiplicity types of particles;
2. Reordering, which includes the arrangement of the particles in an order different from the beginning.
3. Union, which includes selecting two or more types of particles and bringing them closer together until they are forced against one another, for the purpose of bringing them into contact or of merging them or of including them one within the other.
4. Separation, which includes separating particles that initially were in contact with one another, within certain distance from one another, or uniformly distributing in the media.
5. Trapping (or focusing), which includes moving particles to a specific location on the device, and keeping the particles at said location for a specified amount of time.

For purposes of the present disclosure, the terms "detection" and "measurement" are used interchangeably to denote a process of determining a physical quantity such as position, charge, temperature, concentration, pH, luminance, and fluorescence, etc. Normally at least one detector (or sensor) is used to measure a physical quantity and convert it into a signal or information which can be read by an instrument or a human. One or more components may be used between the object being measured and the sensor, such as lenses, mirrors, optical fibers, and filters in optical measurements, or resistors, capacitors, and transistors in electronic measurements. Also, other apparatuses or components may be used to make it easier or possible to measure a physical quantity. For example, when fluorescence intensity is used to deduce the particle concentration, a light source, such as a Laser or Laser diode, may be used to excite the particles to the electronic excited states from their electronic ground state, which emits fluorescence light when returning to their ground states. The sensors can be a CCD (Charge Coupled Device), APD, CMOS camera, a photodiode, and a photomultiplier tube, etc., in optical measurements, or operational amplifier, analog-to-digital convertor, thermocouple, and thermistor, etc., in electronic measurements.

Detection or measurement can be done to a plurality of signals from a plurality of products, either simultaneously or sequentially. For example, a photodiode can be used to measure of the fluorescence intensity from a particular type of particles in a droplet, while the position of the droplet is being sensed by a capacitance measurement at the same time. Also, a detector (or sensor) can include or be operably linked to a computer, e.g., which has software for converting detector signals to information that a human or other machine can understand. For example, the fluorescence intensity information is used to deduce the concentration of can be converted to particle concentration.

Joule heating, also known as ohmic heating or resistive heating, is the process by which the passage of an electric current through a conductor generates heat. The amount of heat released is proportional to the square of the current such that $$P=IV=I^2R=V^2/R$$

P is the power (energy per unit time) converted from electrical energy to thermal energy, I is the current traveling through the resistor or other element, V is the voltage drop across the element, R is the resistance.

This relationship is known as Joule's first law or Joule-Lenz law. Joule heating is independent of the direction of current, unlike heating due to the Peltier effect. It should be pointed out that the current (I) and voltage (V) in the formula are the effective values. When a DC voltage (or current) is used, the effective voltage (or current) value is the same as the DC voltage (or current) value. When using an AC voltage (or current) source, the effective voltage (or current) is the root-mean-square (RMS) value. For example, for a sinusoidal AC wave, the RMS value is the peak value divided by the square root of 2; and for a symmetric bipolar square wave, the RMS value is the same as the peak value.

In practice, both DC and low frequency AC signals are used to control the heating electrodes. The AC signal frequency for controlling the heating electrodes is typically smaller than 10 MHz, and preferably smaller than 100 KHz, and more preferably smaller than 1 KHz The resistance of a heating element can range from 0.1 Ohm to 100,000 Ohms, preferably from 1 Ohms to 10,000 Ohms, and more preferably from 10 Ohms to 1000 Ohms.

For purposes of the present disclosure, a pulse width modulation (PWM) signal is a square wave signal (a signal switched between on and off) with controllable pulse width or duty cycle. The term "duty cycle" describes the proportion of "on" time to the regular interval or "period" of time. Duty cycle is typically expressed in percent, 100% being fully on, and 0% being fully off. PWM is a common used technique for controlling analog circuits using digital outputs.

In electronics, a via or VIA (Vertical Interconnect Access) is an electrical connection between layers in a physical electronic circuit that goes through the plane of one or more adjacent layers. For purposes of the present disclosure, a via is a small opening in the cover plate (non-conductive) that allows a conductive connection between the top surface of the cover plate and the heating electrodes.

The design of the heating electrodes provided will now be illustrated, along with some potential applications, with reference being made as necessary to the accompanying FIGS. 1-8.

Figure 1B:
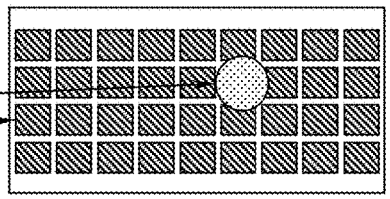
Figure 1C:
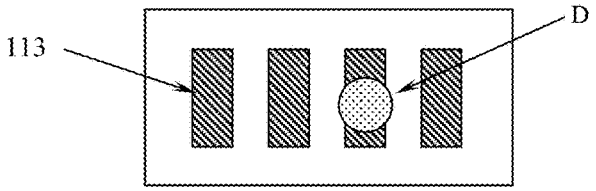
Figure 2A:
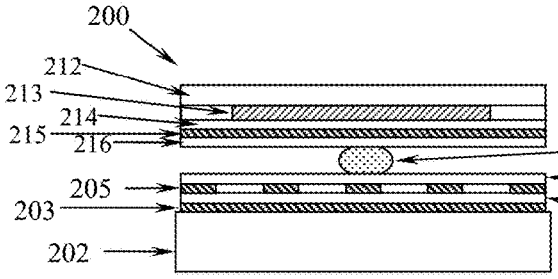
FIGS. 2A-2D present two cross-sectional views, 90 degrees relative to each other, of a dual-layer-electrode-control of a droplet microfluidic device with heating electrodes on the cover plate, along with the top views of the droplet control electrodes and the heating electrodes.
Figure 2B:
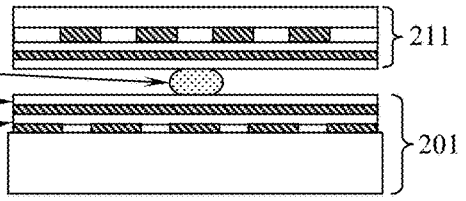
Figure 2C:
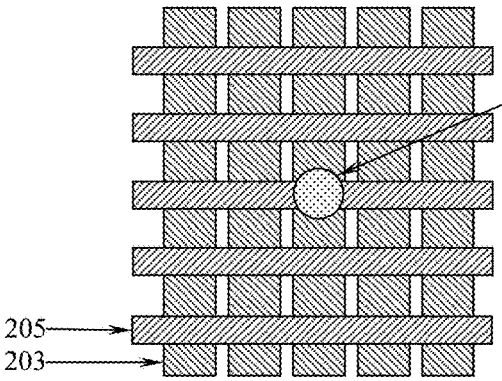
Figure 2D:
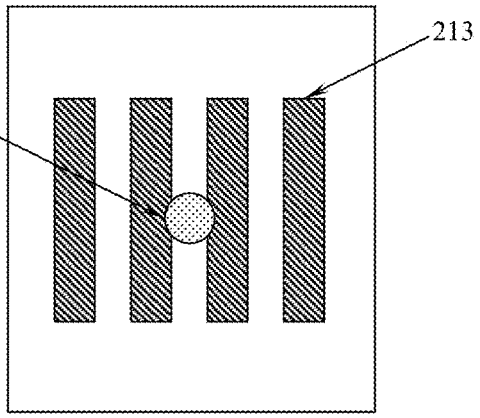

Referring now to FIGS. 1A, 1B and 10, a droplet microfluidic device (designated 100) with heating electrodes is illustrated as a preferred embodiment for effecting heat exchanging reaction of a droplet D. In this embodiment, as shown in FIGS. 1A, 1B and 10, droplet D is sandwiched between a lower plate, designated 101, and an upper plate, designated 111. The terms "upper" and "lower" are used in the present context only to distinguish these two planes 101 and 111, and not as a limitation on the orientation of the planes 101 and 111 with respect to the horizontal. Conventionally, the upper plate is also called cover plate, as the droplet control electrodes, designated 103, are disposed on the lower plate.

The material for making the lower plate or the upper/cover plate is not important as long as the surface where the electrodes or the heating electrodes are disposed is (or is made) electrically non-conductive. The material should also be rigid enough so that the lower plate and/or the cover plate can substantially keep their original shape once made. The lower plate and/or the cover plate can be made of (not limited to) glass, ceramic, quartz, or polymers such as polycarbonate (PC), polyethylene terephthalate (PET), or cyclic olefin copolymer (COC).

The number of heating electrodes, designed 113, range from 1 to 1000, but preferably from 2 to 500, and more preferably from 2 to 100. The width of a heating electrode can range from approximately 0.005 mm to approximately 200 mm, but preferably from approximately 0.02 mm to approximately 100 mm, and more preferably from approximately 0.05 mm to approximately 50 mm. The length of a heating electrode can range from approximately 1 mm to approximately 1000 mm, but preferably from approximately 5 mm to approximately 200 mm, and more preferably from approximately 10 mm to approximately 100 mm. The shape of a heating electrode can be, but not limited to, rectangular, square, saw-tooth, serpentine, and spiral, etc.

The heating electrodes can be made of any electrically conductive material such as platinum, aluminum, copper, chrome and indium-tin-oxide (ITO), and the like.

Layers 104, 114, and 116 are thin films of dielectric materials, which can be, but not limited to, Teflon, Cytop, SU8, CEP, Parylene C and silicon dioxide, and the like. 115 is a layer of conductive material, which can be, but not limited to ITO, aluminum, copper, etc. Layer 115 is typically electrically grounded. Aside of acting as a grounding electrode, electrode 115 works as a shielding layer to prevent the possible electric and/or magnetic field(s) generated by the heating electrodes 113 from affecting the droplet's motion, shape, position, particle distribution, etc.

It should be pointed out that the spaces between adjacent electrodes at the same layer are generally filled with dielectric material(s) when the covering dielectric layer is disposed. These spaces can also be left empty or filled with gas such as air or nitrogen. All the electrodes at the same layer, as well as electrodes at different layers, are preferably electrically isolated.

FIGS. 2A, 2B, 2C and 2D present another preferred embodiment of droplet microfluidic device (designated 200) with heating electrodes for effecting heat exchanging reaction of a droplet D. Device 200 defers from device 100 in that the droplet control electrodes, 203 and 205, are located in two different layers separated by a layer of dielectric material 204. Similar to device 100, in device 200, the number of heating electrodes, designed 213, range from 1 to 1000, but preferably from 2 to 500, and more preferably from 2 to 100. The width of a heating electrode can range from approximately 0.005 mm to approximately 200 mm, but preferably from approximately 0.02 mm to approximately 100 mm, and more preferably from approximately 0.05 mm to approximately 50 mm. The length of a heating electrode can range from approximately 1 mm to approximately 1000 mm, but preferably from approximately 5 mm to approximately 200 mm, and more preferably from approximately 10 mm to approximately 100 mm. The shape of a heating electrode can be, but not limited to, rectangular, square, saw-tooth, serpentine, and spiral, etc.

The heating electrodes can be made of any electrically conductive material such as platinum, aluminum, copper, chrome and indium-tin-oxide (ITO), and the like.

Layers 204, 214, and 216 are thin films of dielectric materials, which can be, but not limited to, Teflon, Cytop, SU8, CEP, Parylene C and silicon dioxide, and the like. 215 is a layer of conductive material, which can be, but not limited to ITO, aluminum, copper, etc. Layer 215 is a layer of conductive material, which can be, but not limited to ITO, aluminum, copper, etc. Layer 215 is typically electrically grounded. Aside of acting as a grounding electrode, electrode 115 works as a shielding layer to prevent the possible electric and/or magnetic field(s) generated by the heating electrodes 213 from affecting the droplet's motion, shape, position, particle distribution, etc.

Figure 3A:
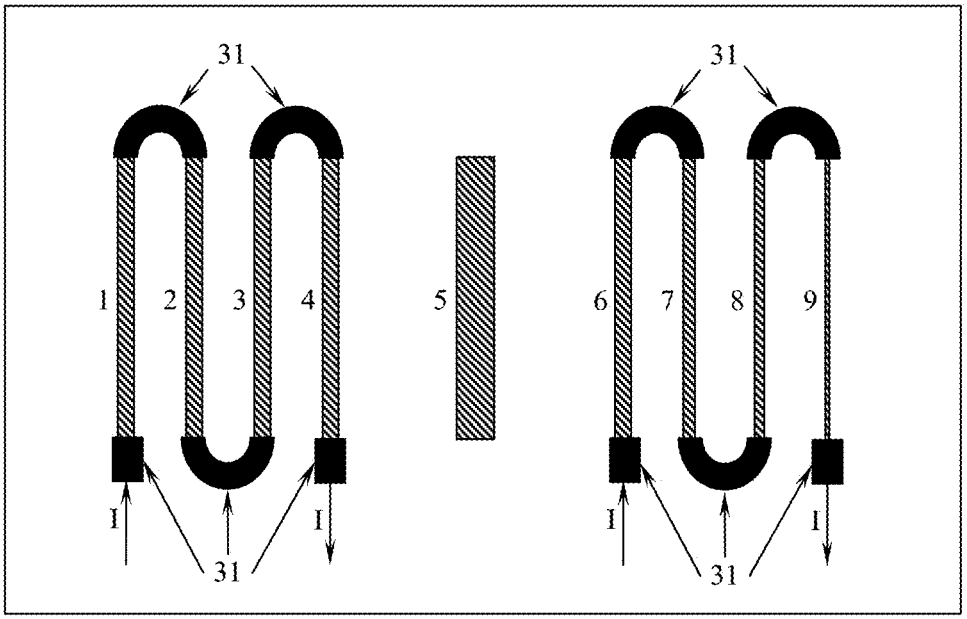
FIGS. 3A and 3B present some of the possible designs of heating electrodes and their connections.
Figure 3B:
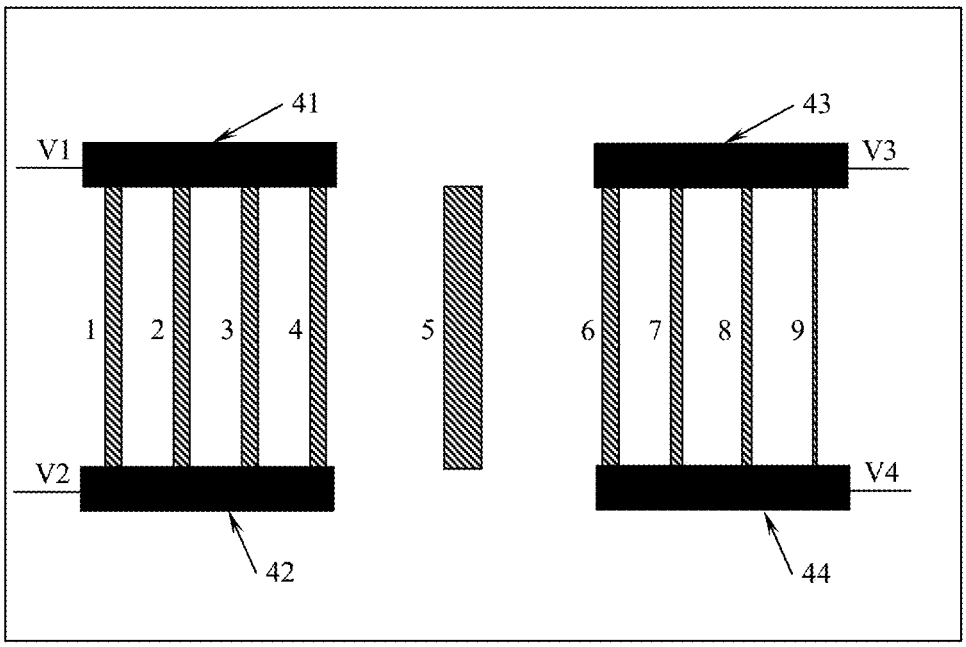

FIGS. 3A and 3B illustrate some of the possible designs of the heating electrodes and their connections.

In FIG. 3A, heating electrodes 1, 2, 3, and 4 have the same resistance. They are connected in series, so that a single current source can be used to energize all of them. The same amount of heat is generated by each of the heating electrodes. Heating electrodes 6, 7, 8, and 9 are also connected in series, but they have the different resistance values. When the same current is going through them, different heating electrodes can generate different amount of heat. In some embodiments, the one with higher resistance value can generate more heat. The connecting electrodes (31) are normally made with much smaller resistance so that the heat generated by them is insignificant in a regular operation.

In FIG. 3B, heating electrodes 1, 2, 3, and 4 have the same resistance. They are connected in parallel. When a voltage difference (V1–V2) is applied across them, the same amount of heat is generated by each of the heating electrodes. Heating electrodes 6, 7, 8, and 9 are also connected in parallel, but they have the different resistances. When the same voltage difference (V3–V4) is applied across them, different heating electrodes will generate different amount of heat. The one will lower resistance value will generate more heat. The connecting electrodes (41, 42, 43, and 44) are normally made with much smaller resistance so that the heat generated by them is insignificant in a regular operation.

When the resistance value of a heating electrode is chosen properly, the temperature can be controlled to a specified value when a proper amount of current or voltage is applied to said heating element. In practice, the running states of other heating electrodes, especially the adjacent ones, need to be taken into account when applying current or voltage to a specified heating electrode. But in theory, this makes it possible to control the temperature profile of a DMF device without the need of close-loop temperature control.

As mentioned before, although the heating electrodes show in FIGS. 3A and 3B have elongated rectangular shapes, in practice, they can take on many different shapes such as, but not limited to, curved, zig-zag, spiral, saw-tooth, and serpentine, etc.

Figure 4:
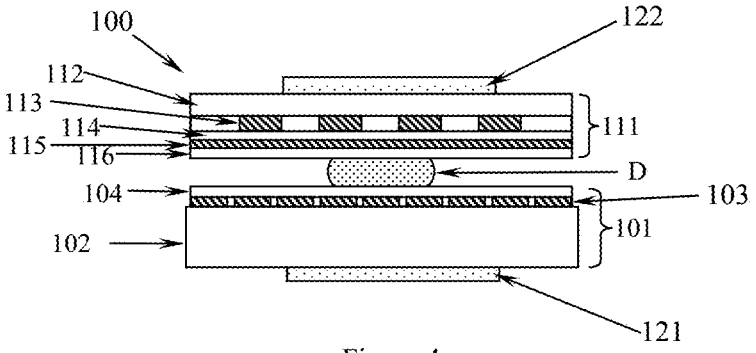
FIG. 4 shows a droplet microfluidic device similar to the in FIG. 1A, but with two external temperature modules.

FIG. 4 presents yet another embodiment of a droplet microfluidic device, which is the same as device 100 in FIGS. 1A, 1B, and 10 except that two external temperature control modules 121 and 122 are incorporated. In some embodiments, 121 and 122 can be temperature control modules such as water or air cooling blocks, Peltiers, resistive heaters, etc., or non-contact modules such as microwave heating and photonic-based heating fixtures.

It is probably worth mentioning that none of the devices presented herein has active components, such as thin film transistors (TFTs), for the control of droplets or the heating elements. The purpose is to keep the manufacturing cost low, and the devices more reliable.

Droplet microfluidics combined with integrated temperature control offer many advantages. Here are some non-limiting examples.

Example 1

High Throughput qPCR with Heating Electrodes

The present devices can make it easy to dispense many reaction droplets and move them to the zones with specified temperature profiles for heat exchanging reactions such as PCR. Hundreds, even thousands, of PCR reactions can be performed simultaneously.

Figure 5A:
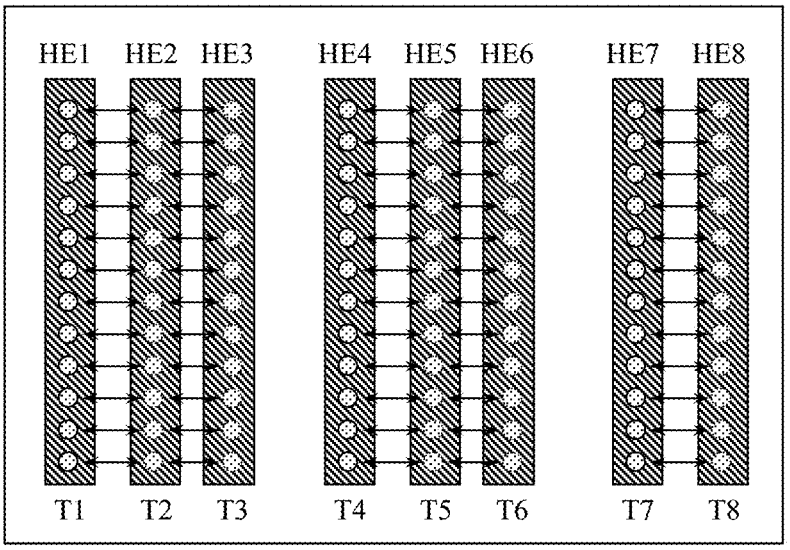
FIG. 5A presents a schematic design of heating electrodes so that many temperature zones are created, with the temperature profile in each temperature zone being suited for a particular reaction.

As an example, FIG. 5A shows that 8 temperature zones are created in a droplet microfluidic device. The circles represent PCR reaction droplets. Heating electrodes HE1, HE2, and HE3 control the left three zones to temperature settings T1, T2 and T3, respectively; heating electrodes HE4, HE5, and HE6 control the three zones in the middle to temperature settings T4, T6 and T6, respectively; and heating electrodes HE7 and HE8 control the two zones on the right to temperature settings T7 and T8, respectively. Zones 1-3 (with temperature values at T1, T2, and T3) and zones 4-6 (with temperature values at T4, T5, and T6) can be utilized to run two different three-step PCRs, in which three different temperatures are needed for DNA denaturation, annealing, and extension. Zones 7 and 8 (with temperature values at T7 and T8) can be used to run a two-step PCRs, in which only two temperatures are needed as annealing and extension take place at the same temperature.

Figure 5B:
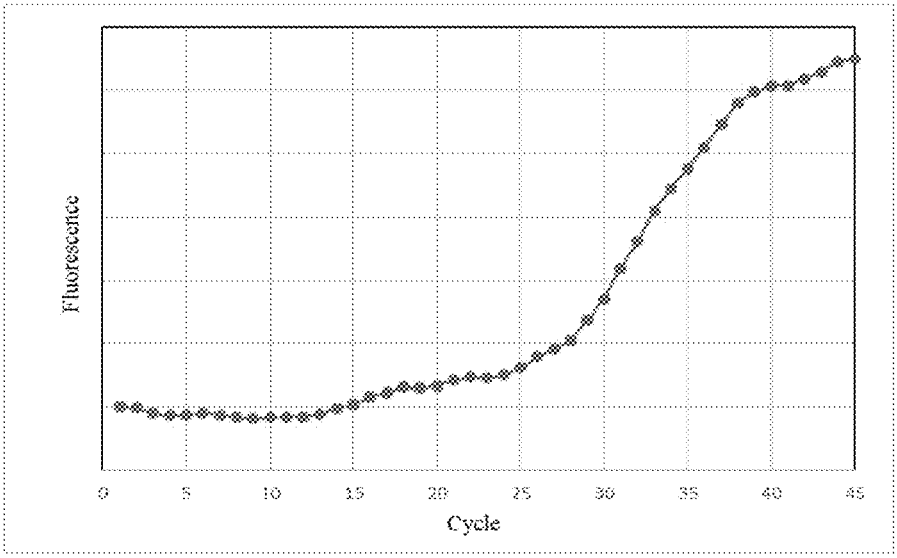
FIG. 5B is the qPCR data collected from a DMF device with the heating electrodes (the integrated heaters).

FIG. 5B is a two-step qPCR data running on a DMF device with on-chip heating electrodes. A layer of shielding electrode is disposed to cover the heating electrodes. It should be pointed out that the shielding electrode and the heating electrodes are at two different layers separated by a layer of dielectric material. DMF devices can be built without the shielding electrode. It is noticeable that the droplet operations become problematic when the heating electrodes are enabled. For example, once a droplet is moved to a location that is under one of the enabled heating electrodes, it becomes difficult, sometimes impossible, to move it away from that location.

DBS-2000 DNA Analyzer, an instrument design and manufactured by Digital BioSystems, was used for the droplet control and the fluorescence data collection in FIG. 5B. The resistances of the heating electrodes were about 200 Ohms. The reaction droplet volume was about 1.5 uL. The denaturation temperature was set at 95° C., and the annealing/extension temperature was 60° C.

As a droplet typically has the shape of a round disk with thickness of a few hundred micrometers or less, the time it takes for it to reach temperature equilibrium is very short (less than one second). The droplet can move fast too. So, PCR reactions run very fast on a droplet microfluidic device. Using DBS-2000 instrument, it is common to design PCR reaction with each temperature cycle time less than 20 seconds for droplets at around 2 uL in volume. With system optimization or smaller droplets, the PCR reaction can be run even faster.

It is worth pointing out that digital PCR can be implemented using droplet microfluidic devices with similar design. By diluting the sample and making the droplets smaller, the sample can be separated into a large number of partitions and the reaction is carried out in each partition individually. As mentioned before, a 45-cycle PCR can be done in 15 minutes or less. Hence, the present disclosure presents a new and improved platform for digital PCR.

Example 2

Isothermal Amplification and PCR on the Same DMF Device

Figure 6:
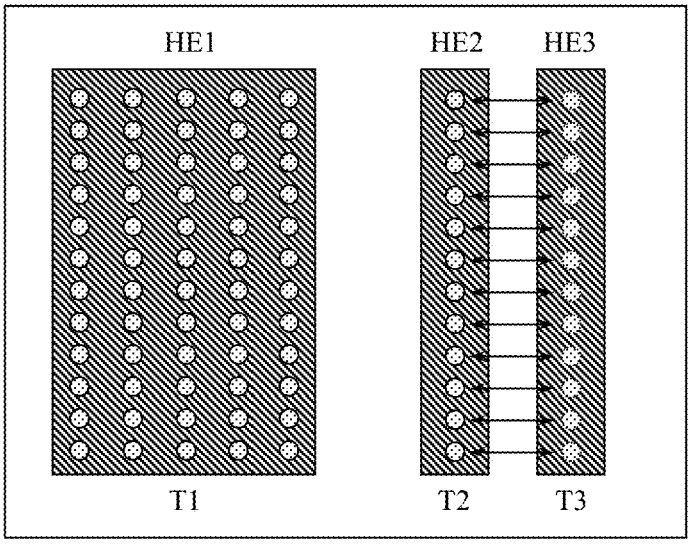
FIG. 6 presents another schematic design of the heating electrodes, which allows isothermal amplification and PCR amplification of DNA molecules being carried out on said device at the same time.

FIG. 6 presents a schematic design of the heating electrodes on a DMF device so that the heating electrode HE1 controls the left part of the device to a temperature (T1), which is suitable for the isothermal amplification of DNA1, and heating electrodes HE2 and HE3 control two other areas with temperatures (T2 and T3), which are suitable for a two-step PCR DNA2.

Reaction droplets for the isothermal amplification can be generated/dispensed and move to the T1 temperature area, and PCR reaction droplets are generated/dispensed and move to T2 temperature area. During experiments, droplets in area T1 stay stationary, and droplets in T2 area are moved back and forth between T2 and T3 temperature areas so that the PCR temperature cycling can be performed. Fluorescence from all the droplets can be collected real-time during the experiments so that quantitative measurement of the DNAs in both regions can be achieved.

Example 3

Flow-Through PCR and Melting Curve Analyses with Heating Electrodes

Figure 7:
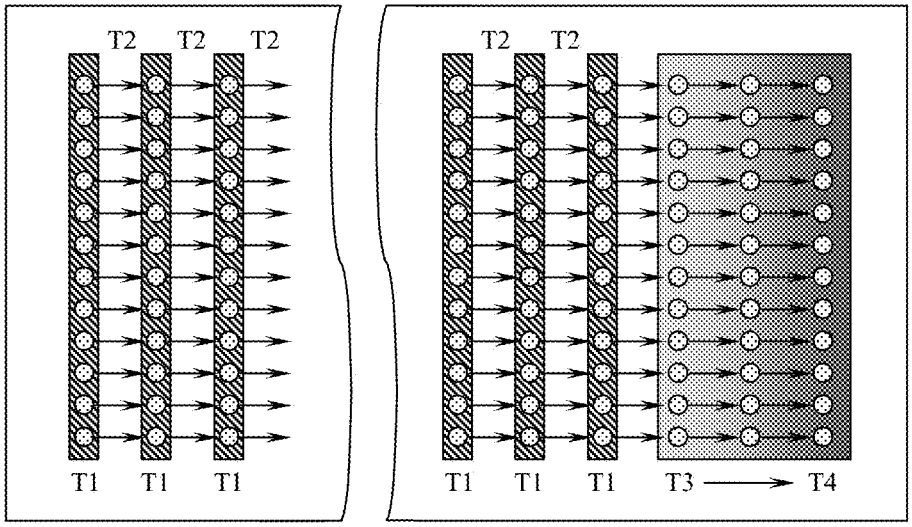
FIG. 7 presents yet another application of a droplet microfluidic device with heating electrodes, in which flow-through PCR amplification DNA is performed following by melting curve analyses.

FIG. 7 illustrates a schematic design of the heating electrodes on a DMF device so that temperature zones T1 and T2 are repeated (about 40 times), so that when a droplet can go through many PCR temperature cycles (for a two-step PCR) by traveling from through the regions from the left to the right. A similar design can be done for three-step PCR too. On the right of the device, an area of temperature gradient from T3 (typically 50° C. or higher) to T4 (typically 95° C. or lower) is created on the device, so that a melting curve analysis can be performed for a PCR amplified droplet.

The device can be designed in such a way that droplets can be dispensed continuously from the sample wells on the left on the device and moved through the PCR zones and eventually through the melting curve analysis zone, and finally moved to the waste wells on the right.

Many applications can take advantage of this design in FIG. 7, one of which is the possibility of point-of-arrest forensic analysis.

There are about 3 billion base pairs in the human genome—most of them are the same among human beings. However, a small percentage (less than 0.5%) of the human DNA sequence differs, and these are the polymorphic sequences used in forensic applications.

The DNA sequences used in forensic DNA profiling are non-coding regions that contain segments of short tandem repeats or STRs. STRs are very short (normally 2-5 base pairs) DNA sequences that are repeated in direct head-to-tail fashion. For example, the 16 base-pairs sequence of "GATAGATAGATAGATA" would represent 4 head-tail copies of the tetramer "GATA". STR analysis compares specific loci (regions of chromosomes) on DNA from two or more samples. These differences allow for distinguishing between individuals, despite the fact that humans share the overwhelming majority of the same DNA. In criminal investigations, there are normally thirteen regions that are analyzed and compared to establish profiles. The chances of two people having the exact same thirteen regions are virtually impossible—less than one in a billion.

STR analysis involves the extraction of nuclear DNA from cells in a sample and certain regions of the DNA are extracted. Currently, a typical way of finding out the number of repeats of the STR sequence in the extracted DNA is through PCR followed gel electrophoresis, which is a lengthy and expensive process. The present devices allow STR analysis to be done using PCR followed by melting curve measurement [French D J, et al, Interrogation of short tandem repeats using fluorescent probes and melting curve analysis: A step towards rapid DNA identity screening. Forensic Science International: Genetics 2 (2008) 333-339]—all on the same device shown in FIG. 7. Since the on-chip PCR reactions and melting curve measurement can be done fast and with minimum lab requirement, this invention makes it possible to find forensic DNA evidence at the point-of-arrest.

Example 4 qPCR Analysis of Raw Sample

Figure 8:
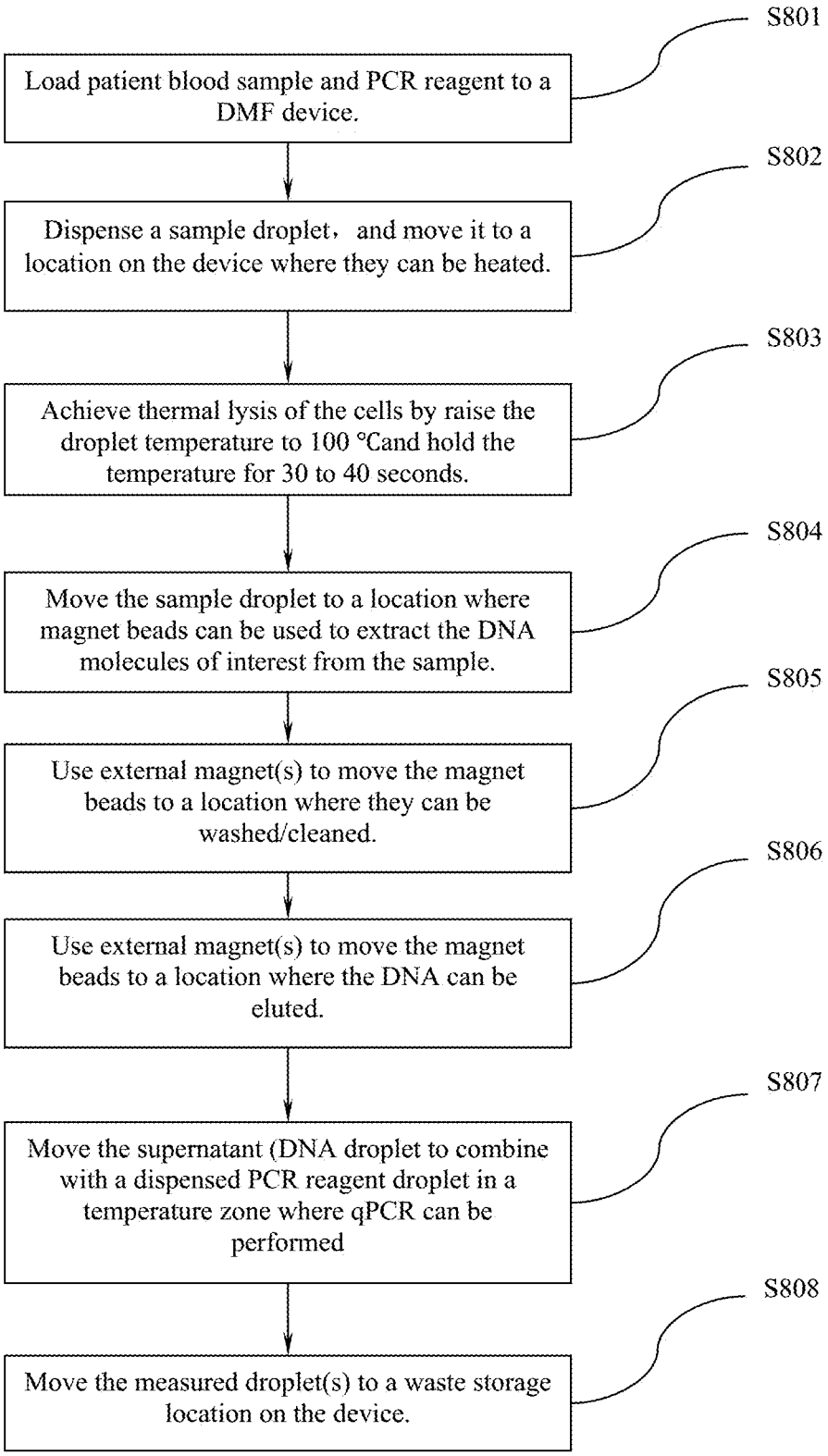
FIG. 8 presents yet another application of a droplet microfluidic device with heating electrodes, in which cell lysis, DNA extraction, amplification and analysis are all performed on the same device.

FIG. 8 shows an example of extracting DNA sample from a whole blood and analyzing it using a described DMF device. In step S801, a DMF device is loaded with the patient whole blood sample and the reagent (including DNA primers, DNA polymerases, dNTPs, etc.) for running qPCR. S802, a sample droplet is dispensed from the sample well and moved a region on the device where the temperature is controlled to a specified value for thermal treatment of the cells. S803, cell lysis is performed by raising the temperature of the sample droplet to around 100° C. for a brief period of time (for example, 30 to 40 seconds). S804, move the sample droplet to a location where DNA extraction using magnet beads takes place. S805, use magnets (external to the DMF device) to drag the magnet beads to a location where the beads can be washed. S806, use the magnets to move the beads to a location where the DNA molecules can be eluted from the beads. S807, move the supernatant, which contains the eluted DNA molecules, to merge/mix with a dispensed PCR reagent droplet, and then move mixed droplet to a temperature zone where the qPCR measurement can be performed. S808, move the measured droplet(s) to a waste storage location on the device.

FIG. 8 shows only one of the many possible applications for carrying out biochemical analyses by simply loading a DMF device as described with raw material and the corresponding reagents. The DMF device provides many functions such as extracting analytes from the raw material, and carrying out detection on them. Examples include, but are not limited to, blood chemistry measurements, such as blood gases, glucose, electrolytes, urea, etc., in whole blood; the measurement of sweat electrolytes in sweat for cystic fibrosis diagnostics; and the measurement of interleukin 1-beta (IL-1β) and interleukin 8 (IL-8), etc., in saliva, to detect oral squamous cell carcinoma; etc.

It should be pointed out that the use of heating electrodes inside a DMF device offer great advantages comparing to external heaters, for example, saving room for other actuators such as magnets, and clearing the path for things like Laser excitation and fluorescence detection, to name two.

It should be mentioned that the above described examples and the above mentioned advantages are by no means exhaustive. The flexible nature of this invention can be utilized for many applications and does have a lot of advantages comparing other technologies such as microfluidic devices with only the external temperature controls.

All printed patents and publications referred to in this application are hereby incorporated herein in their entirely.

While the preferred embodiments of the invention have been illustrated and described, it will be appreciated that various changes can be made therein without departing from the spirit and scope of the invention.

The above described embodiments are only used to illustrate the principles and their effects of this invention, and are not used to limit the scope of the invention. For people who are familiar with this technical field, various modifications and changes can be made without violating the spirit and scope of the invention. So, all modifications and changes without departing from the spirit and technical guidelines by anyone with common knowledge in this technical field are still covered by the current invention.

The invention claimed is:

1. An apparatus for droplet manipulations, comprising:

a. a first substrate comprising a first substrate surface;

b. an array of droplet control electrodes disposed on the first substrate surface;

c. a first dielectric layer disposed on the first substrate surface to cover at least some of the droplet control electrodes;

d. a second substrate, comprising a second substrate surface facing the first substrate surface, spaced from the first substrate surface by a distance to define a space between the first and the second substrates, wherein the distance is sufficient to contain a droplet disposed in the space;

e. one or more heating electrodes disposed on the second substrate surface;

f. a second dielectric material layer disposed on the second substrate surface to cover at least some of the heating electrode(s);

g. one or more shielding electrodes disposed on the second substrate surface to cover at least a portion of the second dielectric material layer; and h. a third dielectric material layer disposed on the second substrate surface to cover at least some of the shielding electrodes.

2. The apparatus of claim 1, wherein two or more heating electrodes are connected in series.

3. The apparatus of claim 1, wherein two or more heating electrodes are connected in parallel.

4. The apparatus of claim 1, wherein at least a portion of the first dielectric layer is hydrophobic.

5. The apparatus of claim 1, wherein at least a portion of the third dielectric layer is hydrophobic.

6. The apparatus of claim 1, wherein the droplet control electrodes are in two layers separated by a layer of dielectric material.

7. The apparatus of claim 1, further comprising an electrode selector for sequentially activating and de-activating one or more selected droplet control electrodes to sequentially bias the selected droplet control electrodes actuation voltages, whereby a droplet disposed on the substrate surface moves along a desired path defined by the selected droplet control electrodes.

8. The apparatus of claim 7, wherein the electrode selector comprises an electronic processor.

9. The apparatus of claim 1, further comprising electric circuits for providing current signals to control one or more of the heating electrodes.

10. The apparatus of claim 1, comprising electric circuits for providing voltage signals to control one or more of the heating electrodes.

11. The apparatus of claim 1, comprising electric circuits for providing PWM signals to control one or more of the heating electrodes.

12. The apparatus of claim 1, wherein vias are made on the second substrates through which the control signals can be provided to the heating electrodes.

13. The apparatus of claim 1, wherein electric contacts are made between the heating electrodes (on the second substrate) and connection electrodes made on the first substrates, so that control signals for said heating electrodes can be provided through the connections electrodes on the first substrate.

14. The apparatus of claim 1, wherein the liquid is an electrolyte.

15. The apparatus of claim 1, further comprising a droplet inlet communicating with the surface.

16. The apparatus of claim 1, further comprising a droplet outlet communicating with the surface.

17. The apparatus of claim 1, wherein the heating electrodes are fabricated to have specific resistance values so that when specified signal levels are provided, the heating electrodes can be controlled to specified temperatures.

18. The apparatus of claim 17, wherein the specified signal levels are voltage, currents, duty cycle, or a combination thereof.

19. The apparatus of claim 1, wherein the conductive material chosen to make the heating electrodes has significant coefficient of resistance so that the resistance changes of the heating electrodes during heating process can be used to calculate the temperature changes of the heating electrodes.

* * * * *